US005669833A

United States Patent [19]

Stone

[11] Patent Number: 5,669,833

[45] Date of Patent: Sep. 23, 1997

[54] SOCCER TRAINING SYSTEM

[76] Inventor: David B. Stone, 139 Denman Rd., Cranford, N.J. 07016

[21] Appl. No.: 701,156

[22] Filed: Aug. 21, 1996

[51] Int. Cl.[6] ..... A63B 69/00

[52] U.S. Cl. ..... 473/422; 434/251

[58] Field of Search ..... 473/420, 415, 473/416, 422, 438, 440; 434/251

[56] References Cited

U.S. PATENT DOCUMENTS

| | | | |
|---|---|---|---|
| D. 295,026 | 4/1988 | Lin | D10/113 |
| D. 348,412 | 7/1994 | Hazelton | D10/113 |
| 2,685,140 | 8/1954 | Nedwick | 35/59 |
| 3,255,115 | 6/1966 | Peterson | 272/57 |
| 3,498,613 | 3/1970 | Dreyer | 473/594 X |
| 3,709,489 | 1/1973 | Holleran et al. | 273/1 B |
| 4,108,435 | 8/1978 | Coleman | 273/55 R |
| 4,134,586 | 1/1979 | King | 273/55 R |
| 4,516,769 | 5/1985 | Kopp | 273/1 B |
| 4,795,164 | 1/1989 | Morpeau | 273/411 |

*Primary Examiner*—William H. Grieb

*Attorney, Agent, or Firm*—Miller, Canfield, Paddock and Stone

[57] ABSTRACT

A system for training an athlete in kicking and dribbling a soccer ball employs a flexible cord that defines a dribble path along the playing surface. The flexible cord is maintained at a predetermined height above the playing surface by a plurality of stanchions arranged in spaced relation, which may be in the form of hollow cones similar to those employed in traffic control. The stanchions may be hollow, and access provided to the interior thereof, for depositing a weighting material, such as sand or water, to improve the stability of the training system during a training session. In accordance with a method aspect, a predetermined dribble path is defined by the flexible cord which is maintained at the predetermined height above the playing surface, sufficient to permit the soccer ball to be dribbled thereunder by the plurality of stanchions. The athlete jumps over the flexible element to gain control over the ball.

26 Claims, 8 Drawing Sheets

SOCCER TRAINING SYSTEM

BACKGROUND OF THE INVENTION

1. Field of the Invention

This invention relates generally to methods and arrangements for training athletes, and more particularly, to a system for training athletes in the skills related to the playing of soccer.

2. Description of the Related Art

Numerous approaches have been provided in the prior art for training athletes in running sports. For example, in order to train athletes in track and/or football, multiple variations have been provided on ribbed runways, whereby the athlete runs across a field with his or her legs on respective sides of a center rib, with cross-members arranged substantially orthogonal thereto, so as to form a grid or a sequence of transverse projections. In use, the athlete will step over each such cross-member sequentially, thereby requiring the legs of the athlete to be raised by at least a predetermined minimum amount and further requiting fairly accurate step positioning of the feet. None of these known arrangements, however, provide the benefit of a training path that meanders, as would be the case with the dribbling of a soccer ball, and additionally are prone to cause injury to the athlete in training in the event of a misstep.

One known approach for achieving an essentially closed training path for improving hockey skills utilizes a plurality of truncated rubber cones, such as traffic cones, arrange such that the athlete can train along a path defined such conical members. However, an arrangement designed to further the development of hockey athletes is not optimal for soccer training. In soccer, it is desired that the athlete gain proficiency in a number of skills that are peculiar to that game. First, there is the need for the athlete to dribble the soccer ball with his or her feet, requiring the athlete not only to kick the ball, but also to stay ahead of it, so as to maintain control thereover. In addition, the soccer athlete should be trained to dribble the soccer ball along a predetermined path designed by the coach who will implement specific strategies and plays. There is a need, therefore, for a soccer training system that will facilitate the training and evaluation of a soccer athlete in dribbling the soccer ball along a predetermined path. There is also a need for a soccer training system that facilitates training directed specifically to plays and strategies that are characteristics of a particular team.

It is, therefore, an object of this invention to provide a simple and economical system for training athletes, and for evaluating their performance, in dribbling skills.

It is another object of this invention to provide a soccer training system wherein the abilities of a soccer athlete can objectively be evaluated.

It is also an object of this invention to provide a training arrangement wherein the ball handling and ball control skills of a soccer athlete are enhanced.

It is a further object of this invention to provide a method of training a soccer athlete in the implementation of specific strategic soccer plays.

It is a still further object of this invention to provide a training system for a soccer athlete that is portable and compact during transportation.

It is a yet another object of this invention to provide a training system for a soccer athlete that can easily be deployed for use on a playing surface.

It is additionally an object of this invention to provide a soccer training system that greatly diminishes the probability of injury to the athlete in training.

It is still another object of this invention to provide a soccer training system that trains an athlete in the skill of dribbling a soccer ball and in jumping, while running, to a height that corresponds to the diameter of the soccer ball.

SUMMARY OF THE INVENTION

The foregoing and other objects are achieved by this invention which provides, in a first system aspect thereof, a system for training an athlete in a kicking/dribble skill with a soccer ball on a playing surface. In accordance with the invention, a flexible dribble path defining element defines a dribble path on the playing surface along which the athlete is to be trained. A plurality of stanchion elements maintain a flexible dribble path defining element along the dribble path at a predetermined height above the playing surface.

The predetermined height is sufficient to permit the soccer ball to be dribbled by the athlete between the playing surface and the flexible dribble path defining element, whereby the athlete in training will kick the soccer ball under the flexible dribble path defining element, and then jump thereover, so as to kick the ball back under the flexible dribble path defining element from the other side.

In one embodiment of the invention, the stanchion elements are each provided with a base portion having a first end for resting on the playing surface, and a second end for communicating with the flexible dribble path defining element. The stanchion elements, in a preferred embodiment, are hollow, so as to have an internal volume. There is provided an inlet for facilitating loading and unloading of a weighting material into and out of the internal volume of the stanchion element. The weighting material, which may be sand, or a liquid, preferably water, serves to improve the stability of the stanchion element during use of the athletic training system. In another embodiment of the invention, the stanchion elements are configured so they can be nested within one another, thereby enhancing the compactness and portability of the arrangement.

In a further embodiment of the invention, each of the stanchion elements is provided with an engagement member that is coupled to the stanchion element and engages with the flexible dribble path defining elements. The stanchion elements may each have a substantially conical configuration with a broader end thereof at the base which rests on the playing surface.

In accordance with a method aspect of the invention, there is provided a method of training an athlete in a kicking/dribble skill with a soccer ball on a playing surface. The invention is provided with the steps of:

- determining a dribble path over which the athlete is to be trained;
- installing a flexible dribble path defining element for defining a dribble path on the playing surface along which the athlete is to be trained; and
- maintaining the flexible dribble path defining means along the dribble path at a predetermined height above the playing surface, the predetermined height being sufficient to permit the soccer ball to be dribbled by the athlete between the playing surface and the flexible dribble path defining element.

It is a significant aspect of the present invention that the use of the dribble path defining element at the predetermined height will train the athlete to jump, while running, to a height that corresponds to the diameter of the soccer ball. Thus, in addition to providing a flexible element that will not injure the athlete should he or she trip thereon, the athlete will develop the skill to jump over the ball, while he or she is running. In addition to improving the athlete's skill at ball control, the trained athlete will be much less likely to trip over the ball while dribbling, and thereby injuries, such as ankle injuries, are greatly avoided.

In one embodiment of this method aspect of the invention there are provided further steps of first kicking the soccer ball in a first ball travel direction under the flexible dribble path defining element and at least partially along a first direction of the dribble path. There are additionally provided the steps of first jumping over the flexible dribble path defining element at a first location there along; second kicking the soccer ball in a second direction under the flexible dribble path defining element and at least partially along the first direction of the dribble path; and second jumping over the flexible dribble path defining element at a second location there along, the second location being further along the dribble path in the first direction. Thus, the athlete in training will essentially run along the path defined by the dribble path defining element, and kicking the ball thereunder from either side thereof.

In accordance with a predetermined training regimen, the athlete will repeat the steps of first kicking, first jumping, second kicking, and second jumping until a first predetermined portion of the dribble path has been traversed. The use of a dribble path defining element in this manner will assist in the development and refining of specific soccer plays, particularly wherein other members of the team will learn the specific dribble path intended to be followed in the strategy of the predetermined play, and conform their concerted playing efforts accordingly.

Further in accordance with this method aspect of the invention, there are provided the steps of third kicking the soccer ball in a third ball travel direction under the flexible dribble path defining element and at least partially along a second direction of the dribble path. Thus, in training, the athlete will traverse the dribble path in both directions. Again, the steps of third kicking, third jumping, fourth kicking, and fourth jumping are repeated, in the second direction, until the athlete has traversed a second predetermined portion of the dribble path.

In accordance with a further system aspect of the present invention, a system is provided for training an athlete in a kicking/dribble skill with a soccer ball on a playing surface wherein there is provided a flexible element for defining a dribble path, and a stanchion element for supporting the flexible element along the dribble path and at a predetermined height above the playing surface whereby the soccer ball is dribbled thereunder by the athlete. In accordance with this further aspect of the invention, the stanchion has a base portion for supporting the stanchion dement on the playing surface, and elongated central portion, and a top portion. An engagement element is coupled to the top portion of the stanchion element for engaging with the flexible element.

In one particularly advantageous embodiment of the invention, the flexible element is an elongated cord, such as twine or rope. Additionally, the elongated central portion of the stanchion element and the top portion thereof are integrally formed. In such an embodiment, the engagement element is provided with a notch or aperture for engaging the flexible element. Alternatively, the engagement element is provided with a sliding member that engages slidably with the flexible element. In this manner, the flexible element is axially movable with respect to the engagement element.

Also in this system aspect of the invention, the elongated central portion of the stanchion can be made hollow and provided with an aperture or other means for accessing the hollow interior of the elongated central portion for supplying and removing the weighting material. In a preferred embodiment, the elongated hollow portion has a substantially conical, or frustoconical configuration, with a larger diameter in the vicinity of the base portion.

In accordance with a further method aspect of the invention, there is provided a method of training a soccer athlete, the method having the steps of:

urging a soccer ball along the ground in a first direction between first and second spaced-apart stanchions; and jumping in said first direction over a flexible element arranged to be supported above the ground by the first and second spaced-apart stanchions.

In one embodiment of this further method aspect of the invention there are further provided the steps of urging the soccer ball along the ground in a second direction between the first and second spaced-apart stanchions and jumping in the second direction over the flexible element. In this embodiment, therefore, the athlete in training is trained in controlling the ball and jumping to a height that corresponds to the diameter of the ball. Alternatively, the athlete can dribble the soccer ball around the second stanchion and repeat the steps of urging and jumping. Of course, a figure-eight training approach can be configured in accordance with the method aspect of the invention, thereby achieving bidirectional training.

Further in accordance with this method aspect of the invention, there is provided a third stanchion arranged sequentially with the first and second stanchions, the flexible element being arranged to be supported above the ground by the first, second, and third stanchions. After the step of jumping, there are provided the further steps of:

second urging the soccer ball along the ground in a second direction between the second and third spaced-apart stanchions; and second jumping in the second direction over the flexible element between the second and third spaced-apart stanchions. This achieves a bidirectional interweaving form of training. Upon reaching the last stanchion, the player can shoot the ball at a goal, or can pass the ball to a receiving player, as determined by the coach or instructor. A number of competitive team games, that will motivate the players to achieve higher proficiency, can be implemented with an additional stanchion system. Additionally, multiple stanchion systems can be employed to achieve training directed to specific plays, strategies, and types of ball passes.

BRIEF DESCRIPTION OF THE DRAWING

Comprehension of the invention is facilitated by reading the following detailed description, in conjunction with the annexed drawing, in which.

DETAILED DESCRIPTION

Figure 1:
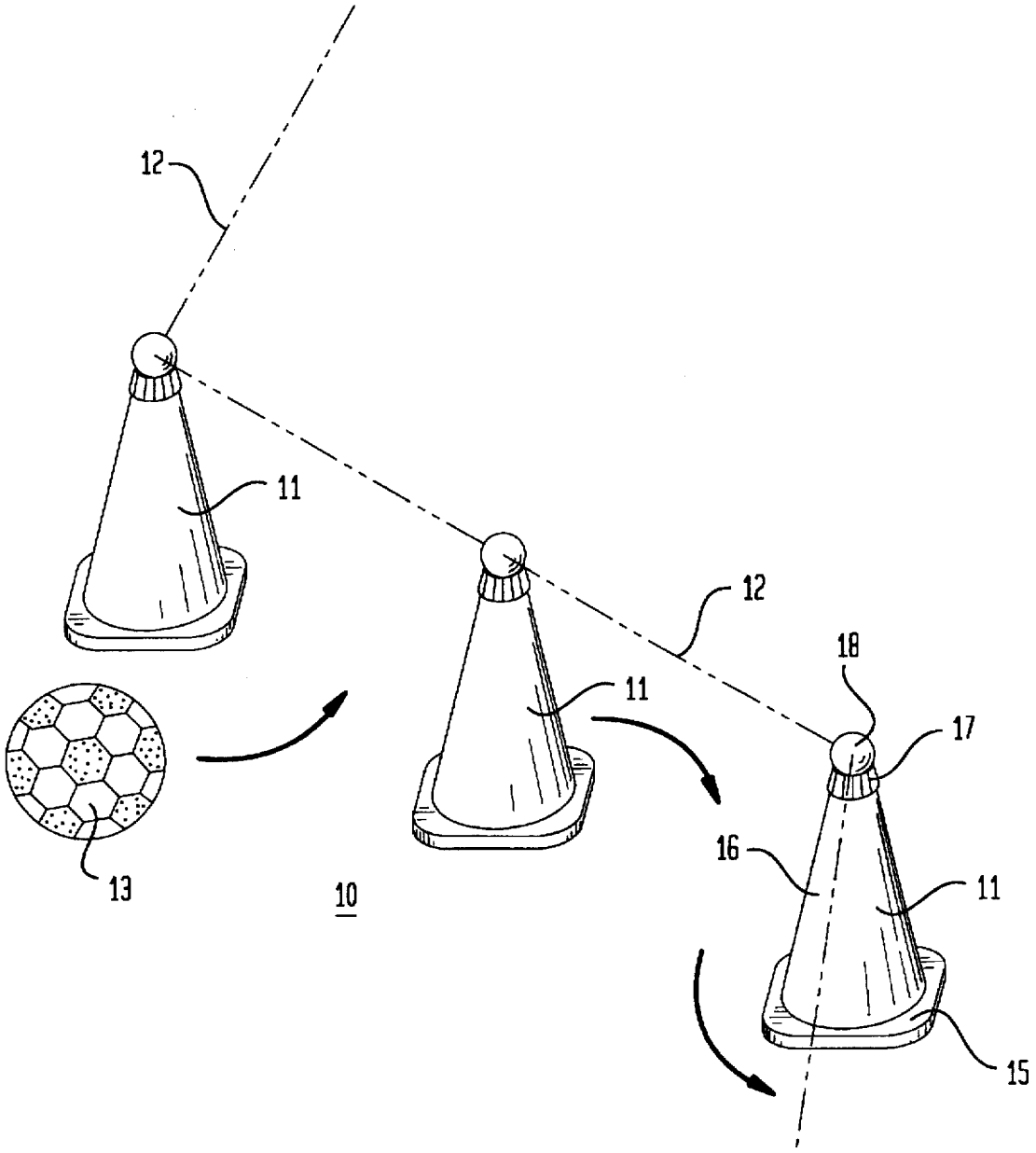
FIG. 1 is a partially schematic isometric representation of a specific illustrative embodiment of the invention.

FIG. 1 is a partially schematic isometric representation of an arrangement 10 for training an athlete (not shown) in certain skills related to the game of soccer. As shown in this figure, a plurality of stanchions 11 are arranged along a predetermined path that is defined by a flexible element 12. The flexible element may be a cord which is supported by the stanchions at a predetermined height above a playing surface (not specifically designated) and at a height that permits a soccer ball 13 to pass thereunder.

In this specific illustrative embodiment of the invention, each of the stanchions has a base portion 15 with an elongated, substantially conical or frustoconical central portion 16 thereon. A top portion 17 has an engagement element 18 thereon that engages with flexible element 12. In this embodiment, engagement element 18 permits flexible element 12 to be slidably movable with respect thereto, whereby slack and the flexible element can be taken up.

In addition, elongated central portion 16 of the stanchions may be hollow (interior not shown) whereby a weighting material (not shown) can be deposited therein. In this specific embodiment, top portion 17 may be in the form of a cap that is removable to expose the interior of the elongated central portion for facilitating deposition and removal of the weighting material. In still further embodiments of the invention, the elongated central portion 16 is hollow, and an aperture is provided in base portion 15 (aperture not shown) whereby the stanchions can be nested in one another to enhance portability of the training system.

Figure 2:
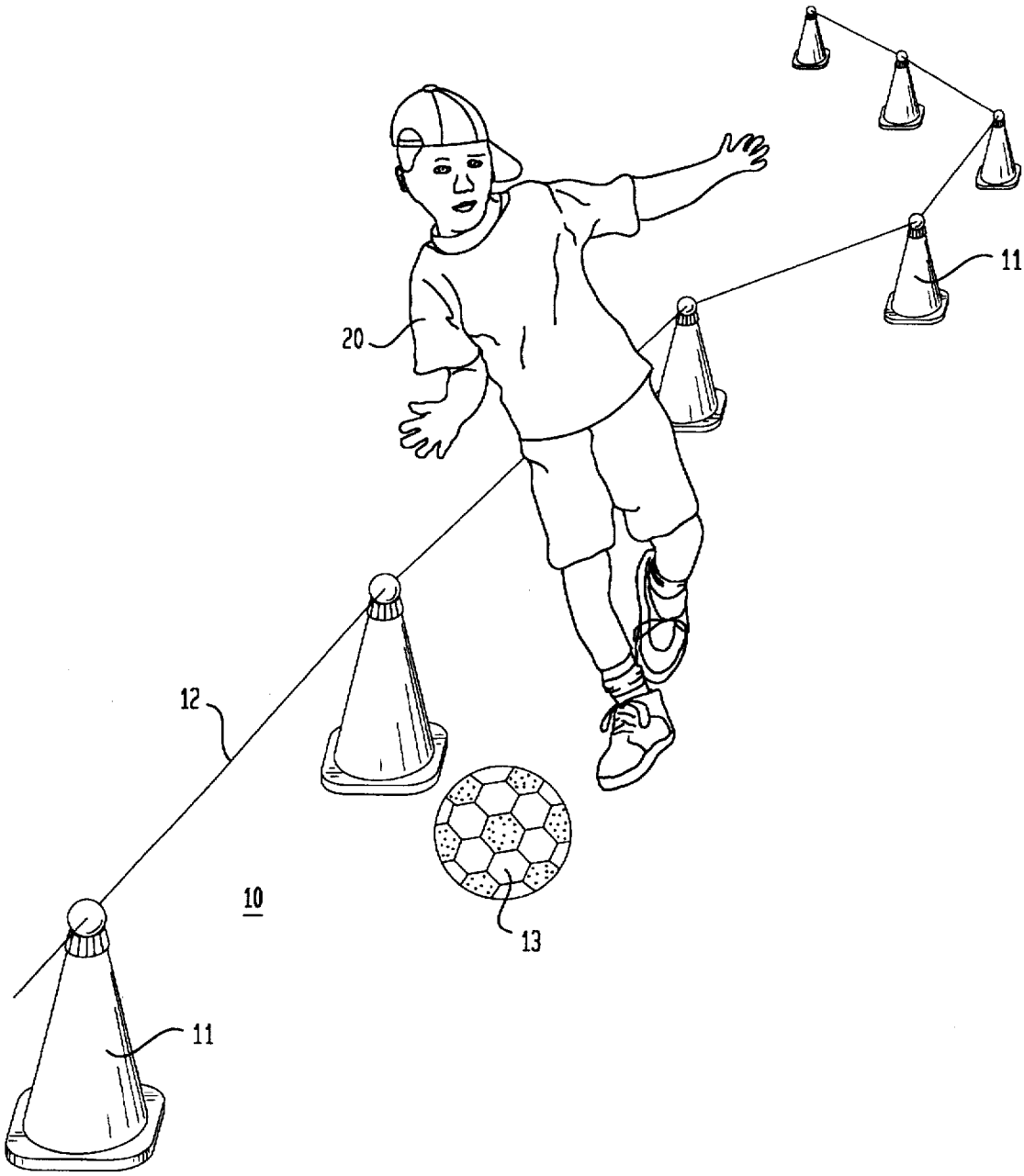
FIG. 2 is a partially schematic isometric representation of the invention showing an athlete in training in accordance with the invention.

FIG. 2 is a partially schematic isometric representation of an embodiment of the invention. Elements of structure that are analogous to those described hereinabove with respect to FIG. 1 are similarly designated. In this figure, training system 10 having stanchions 11 supporting flexible element 12 is shown in use by an athlete 20. The athlete kicks soccer ball 13 underneath flexible element 12 and then jumps thereover to kick the soccer ball thereunder from the other direction. This training arrangement and method provides significant and efficacious practice in the dribbling skill that is essential in the soccer game. A significant aspect of the skill that is enhanced by the present training system is greatly improved ball control. It is a common error of inexperienced soccer athletes to kick the soccer ball too far ahead of themselves, whereby the ball cannot be protected by them from recovery by members of the opposite team. There is, of course, a fear on the part of the player that if the ball is maintained too close to the player during running and dribbling, he or she will trip over the ball. The present training system, in providing flexible element 12, permits the athlete to focus on preventing tripping over the flexible element, rather than the ball. Additionally, the time required for the athlete to jump over the flexible element after the ball instills in the athlete the understanding that the ball must be maintained close to the athlete if its direction is to be controlled and if it is to be protected from his or her opponent.

Also as shown in FIG. 2, flexible element 12 can define a straight or a meandering path along the playing field. The establishment of the path by the flexible element will instill in the athlete in training the particular route to be associated with any given soccer play, the strategy associated therewith being determined by the instructor or coach (not shown).

Figure 3:
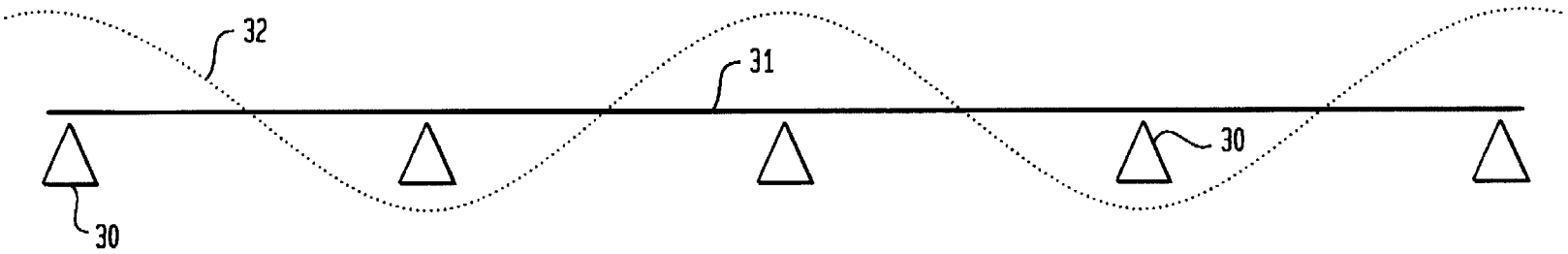
FIG. 3 is a representation of an illustrative physical development exercise performed in accordance with the invention.

FIG. 3 is a schematic representation of an illustrative physical development exercise performed in accordance with the invention. As shown, a plurality of stanchions 30 are arranged to support a flexible element 31, or rope, in a substantially straight arrangement. A number of exercises are performed in this arrangement. First, and athlete (not shown) will kick the ball along a meandering path defined by dotted path line 32. This exercise will require the athlete to jog or run, preferably on the balls of the feet, kick the ball (not shown), and jump over the flexible element. Although there are available numerous exercises for building cardiovascular fitness, including, for example, jogging, swimming, and bicycling, such exercises are useless for developing soccer-specific skills. In order to become proficient at soccer, the athlete must exercise properly the muscle groups needed for soccer, which includes the strengthening of the toes, ankles, calves, shin muscles, hamstrings, knees, thighs, and lower back.

A number of exercise variations can be achieved with the arrangement of FIG. 3. For example, the athlete can be instructed to jog to the cones and hop on one foot over the flexible element. Another exercise involves side-stepping to the rope while sliding the feet (not shown) along the ground, jumping over the rope, and repeating the activity from the other side of the rope. A further exercise includes gripping of the soccer ball (not shown) firmly between the ankles and hopping over the rope. A still further variation involves jumping over the rope with extended arms while twisting with a helicopter-like motion.

Figure 4:
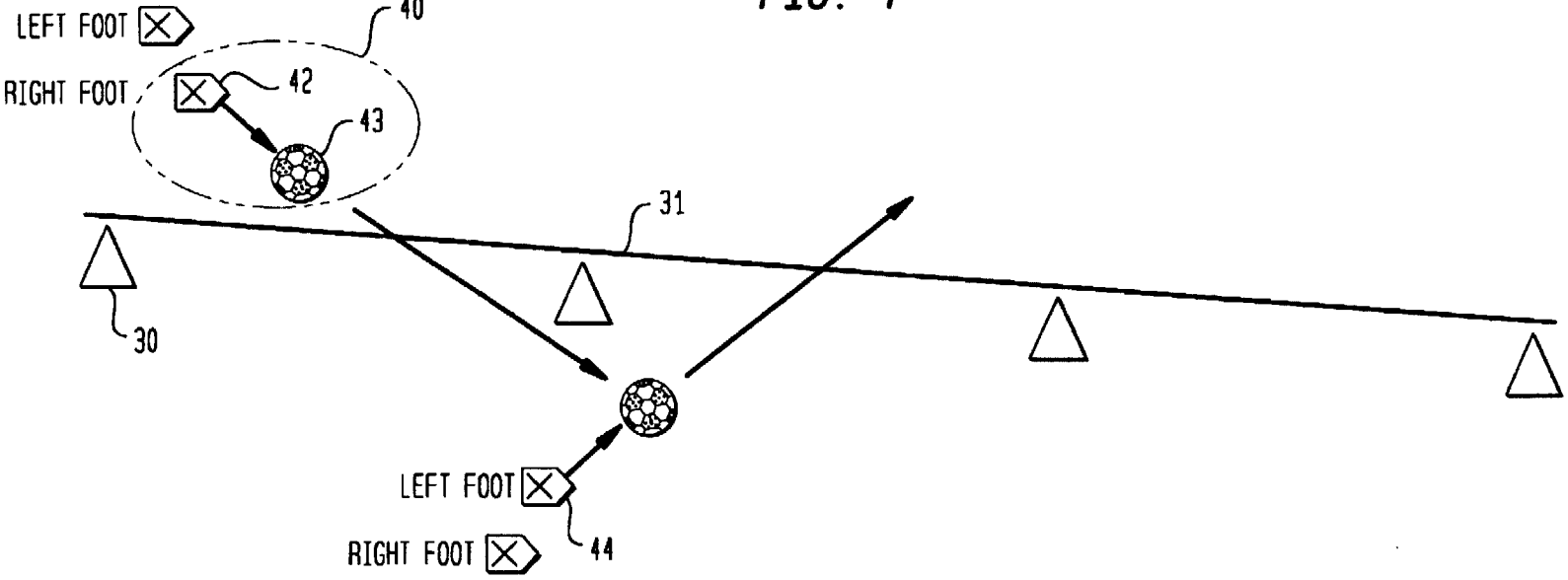
FIG. 4 is a representation of a training exercise conducted in accordance with the invention for teaching control over a soccer ball while changing the direction of travel thereof.

FIG. 4 is a representation of a training exercise conducted in accordance with the invention for teaching control over a soccer ball while changing the direction of travel thereof. This exercise will train an athlete to control, or "settle," the ball. When a coach calls for his team to settle the ball, the coach is asking the team to prepare for a maneuver, such as a move, a pass, a dribble, a fake, a dip, or to take a shot at the goal. The player controlling the ball is expected to make a transition from what was happening to what will be called to happen. With reference to FIG. 4, this transition occurs in a transition zone 40. The player in the transition zone is in a pressurized situation, and his or her responses will indicate immediately any weaknesses in his or her ability to control the ball. If the player lacks transitional ability, the result generally will be loss of possession of the ball (not shown), or poor quality shooting, passing, or trapping.

The exercise depicted in FIG. 4 facilitates the player's development in the transition zone. The player's right foot 42 in transition zone 40 pushes the ball under flexible element 31. The player must then quickly jump over the rope and catch-up to the ball, as shown. The player then pushes the ball with left foot 44 back under the rope to repeat the process. The objective is to maintain control over the ball, and with practice, the player will become faster and more accomplished in the transitional technique. In addition, the athlete will be enabled to develop moves that are particularly comfortable to him or her, including the flick, the dip, the crossover, and the step-over. It is preferred that the player be instructed to receive the ball with his or her arms out wide and body balanced. This technique will take time to master.

Figure 5:
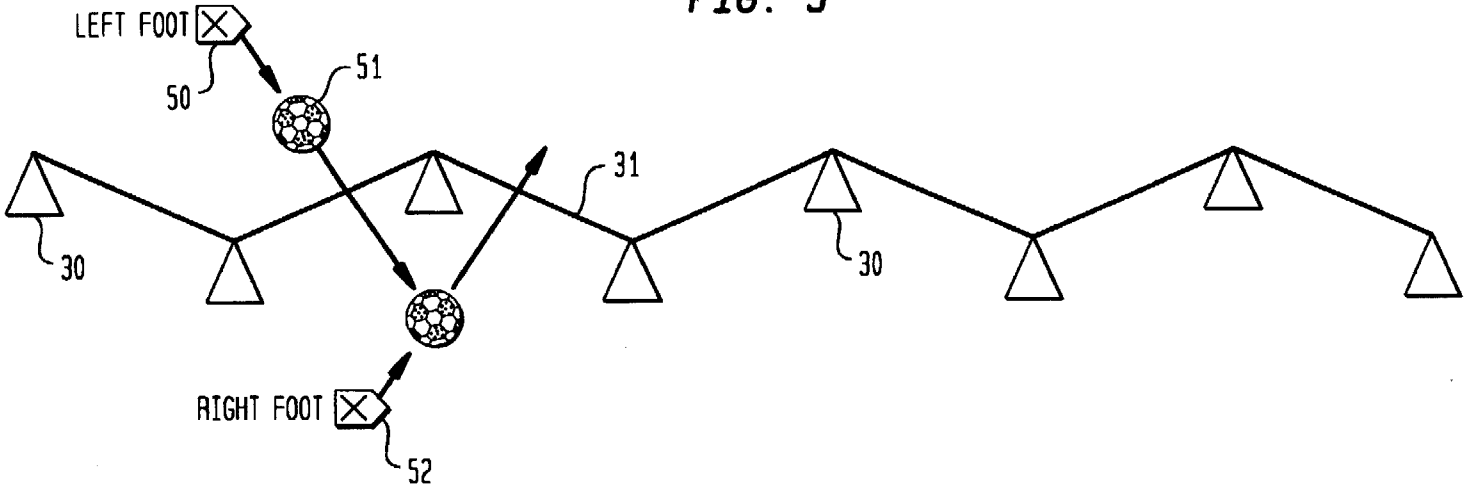
FIG. 5 is an illustration of a zig-zag implementation of the rope and cone embodiment of the invention for achieving a more complicated training environment.

FIG. 5 is a graphical illustration of a specific, illustrative zig-zag implementation of the rope and stanchion embodiment of the invention for achieving a more complicated, or second level, training environment. In this aspect of the invention, stanchions 30 are staggered to achieve a zig-zag configuration of flexible element 31. However, the exercise described herein with respect to this figure can be performed on a straight-line embodiment of the invention, as illustrated in FIG. 3.

Referring to FIG. 5, stanchions 30 are arranged about seven feet apart form each other. Using the instep of both feet, the athlete (not shown) uses the instep of his or her left foot 50 to apply taps or small nudges to soccer ball 51. The athlete dribbles the soccer ball through a series of stanchions, while using only the insteps and while focusing on maintaining balance. Upon urging the ball under the rope, the athlete then jogs over the rope, in the same direction as the ball. It may be necessary to control the ball using a "sole-of-foot" trap or "instep" trap. Once under control, the ball is tapped back under the rope with the instep of right foot 52. Ideally, the right instep pushes the ball toward the left, and the left instep pushes the ball toward the fight. It is a goal of this exercise to achieve a "tap level" whereby the player glides through the stanchions with the ball appearing to be attached to the feet.

The present invention can be applied in the context of a number of exercise games that train the athlete to remain focused on the field and the ball, notwithstanding various distractions. One such exercise game entails timed racing against a clock or an opponent. Players are motivated by improvement in their individual and group times. Other types of exercise are directed to improving the players' ability to concentrate. For example, the coach or instructor will blow a whistle to indicate stopping and starting of dribbling. Such stop-start activity reinforces stop and go ball control function. Moreover, in order to maintain athlete interest, particularly among younger players, the stop-start activity can be combined with a "musical chairs" feature that is useful with four or more players, there being one stanchion less than the number of players. When the whistle blows, the player with the ball must trap the ball next to a stanchion. The player without a nearby stanchion leaves the game, and a stanchion is removed prior to resuming dribbling and passing. Ultimately, a single player will remain. A "sole-of-the-heel" trap is preferred when stopping at the sound of the whistle.

Another variation to the exercise games involves talk-back by an instructor. The instructor engages the player in casual conversation, and the player must answer without losing track of the task at hand. As the player's concentration improves, the tone of the conversation can be modulated from very soft to very loud. This exercise will improve the ability of the player to receive oral instruction on the field without losing control of the ball as a result of the distraction. A still higher level of distraction is achieved by requiring the player to identify the number of fingers being raised by the instructor. This exercise will require the player to focus attention on the ball and on another item simultaneously. He player must learn to become aware of the action on the field and to shift attention very quickly between the task of ball control and the other activity on the field.

Figure 6:
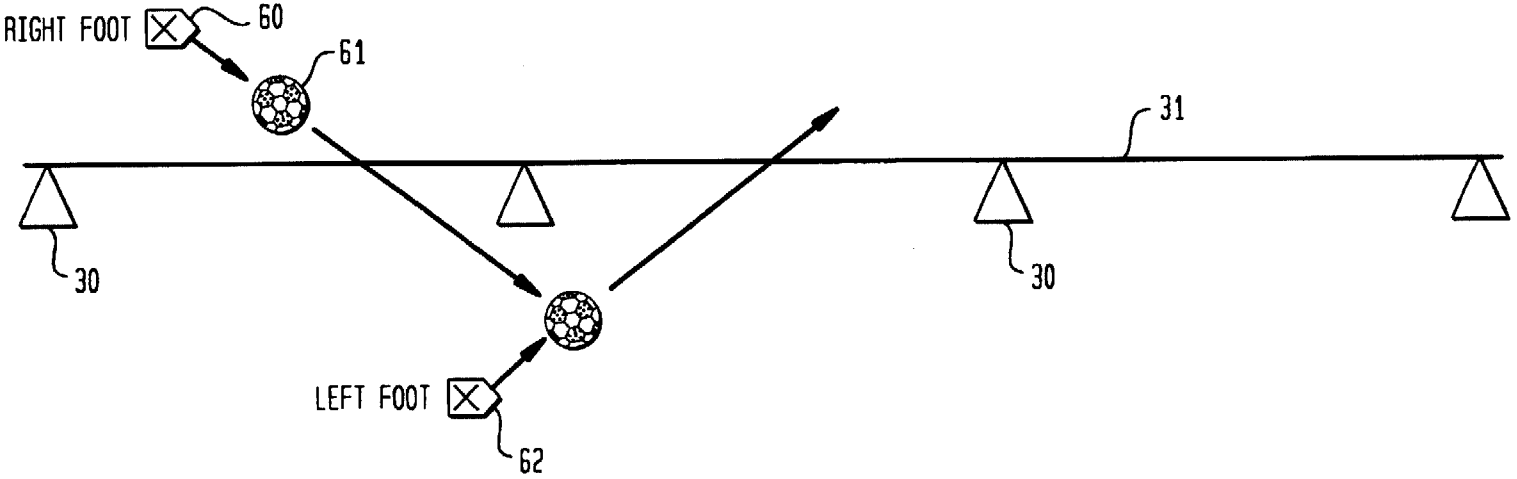
FIG. 6 is an illustration of an embodiment of the invention employed in training athletes in the use of the outside of the feet.

FIG. 6 is a graphical illustration of an embodiment of the invention employed in training athletes in the use of the outside of the feet. This is a higher level of training than that described with respect to FIG. 5. Agility and rhythm are required of the athlete (not shown) in the exercise of FIG. 6. The exercise begins without the flexible element, and with only the stanchions in place, their spacing being determined in response to the comfort of the player. Soccer ball 51 is placed ahead of the toes of the player and between the feet. Ball 61 is tapped with the outside base of the foot, illustratively right foot 60. Preferably, communication with the ball is achieved with the surface above the toes and the side of the foot. The position of the feet gives the appearance of walking "pigeon-toed." It is a goal of the exercise to touch the ball with each foot alternately. Although difficult, a greater degree of skill is achieved if the player rotates each outer foot while dribbling between the stanchions.

Figure 7:
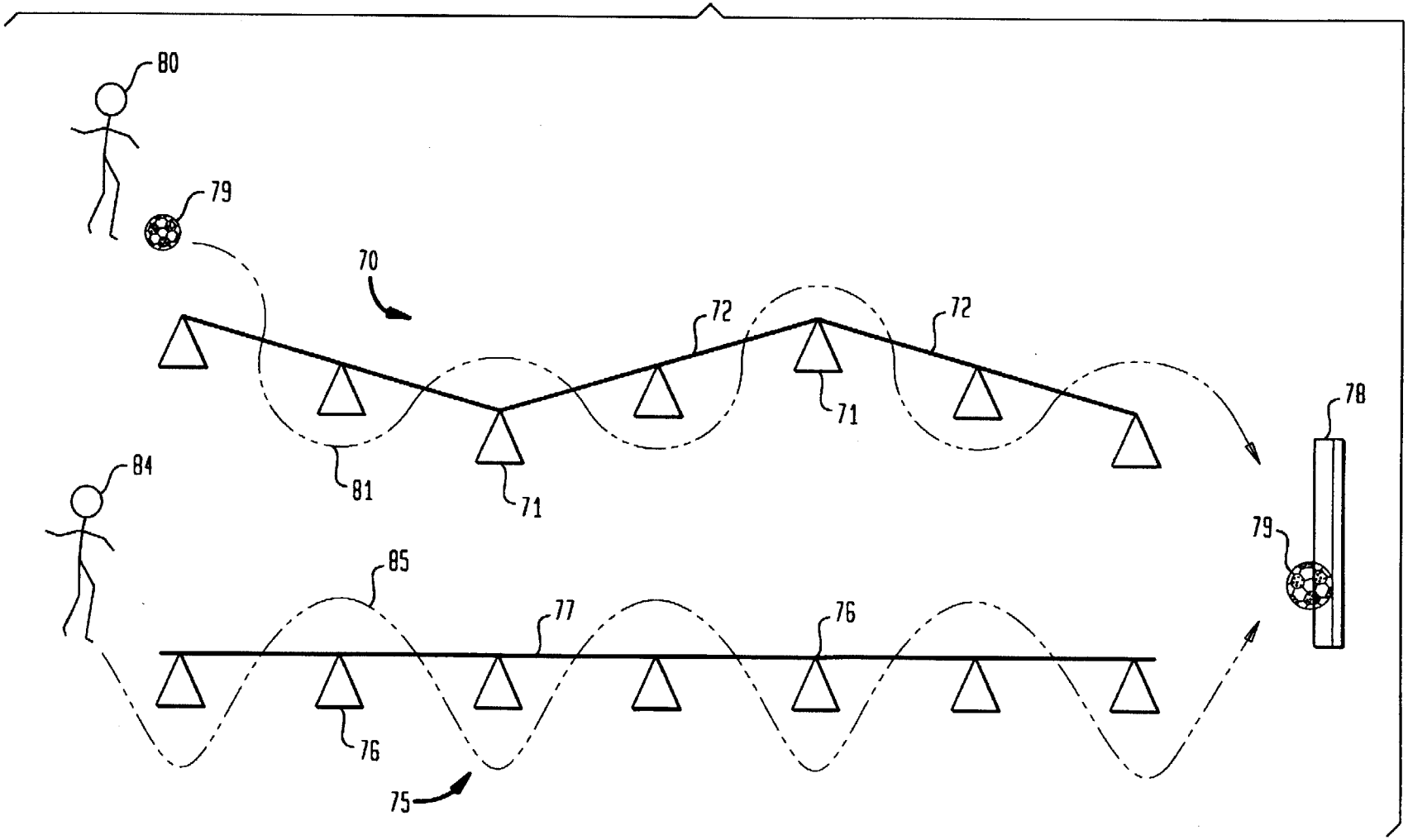
FIG. 7 is an illustration of an embodiment of the invention employed in the practice of an offensive teamwork drill.

FIG. 7 is a graphical illustration of an embodiment of the invention employed in the practice of an offensive teamwork drill to achieve a still higher level of proficiency. As shown, a first stanchion system 70 is arranged to have a plurality of stanchions 71 with a flexible element 72 thereon arranged in a generally zig-zag configuration. A further stanchion system 75 is arranged to have a plurality of stanchions 76 with a flexible element 77 thereon arranged in a substantially straight configuration. Stanchion systems 70 and 75 are arranged substantially parallel to one another, and a goal 78 is disposed at the ends thereof.

In use, a first player 80 with a soccer ball 79 dribbles along a dribble path 81. A second player 84 runs along a path 85, jumping repeatedly over flexible element 77 and keeping pace with player 80. After both players reach the vicinity of the goal, player 80 cross passes the ball to player 84, who takes a shot at goal 78. Each player then can either leave the exercise area or return to the end of the other line. This exercise instructs the players on offensive teamwork, particularly the cooperation of a player with the player in possession of the ball. Goalie training is enhanced by placing a goalie player (not shown) in the vicinity of goal 78 to defend same.

Figure 8:
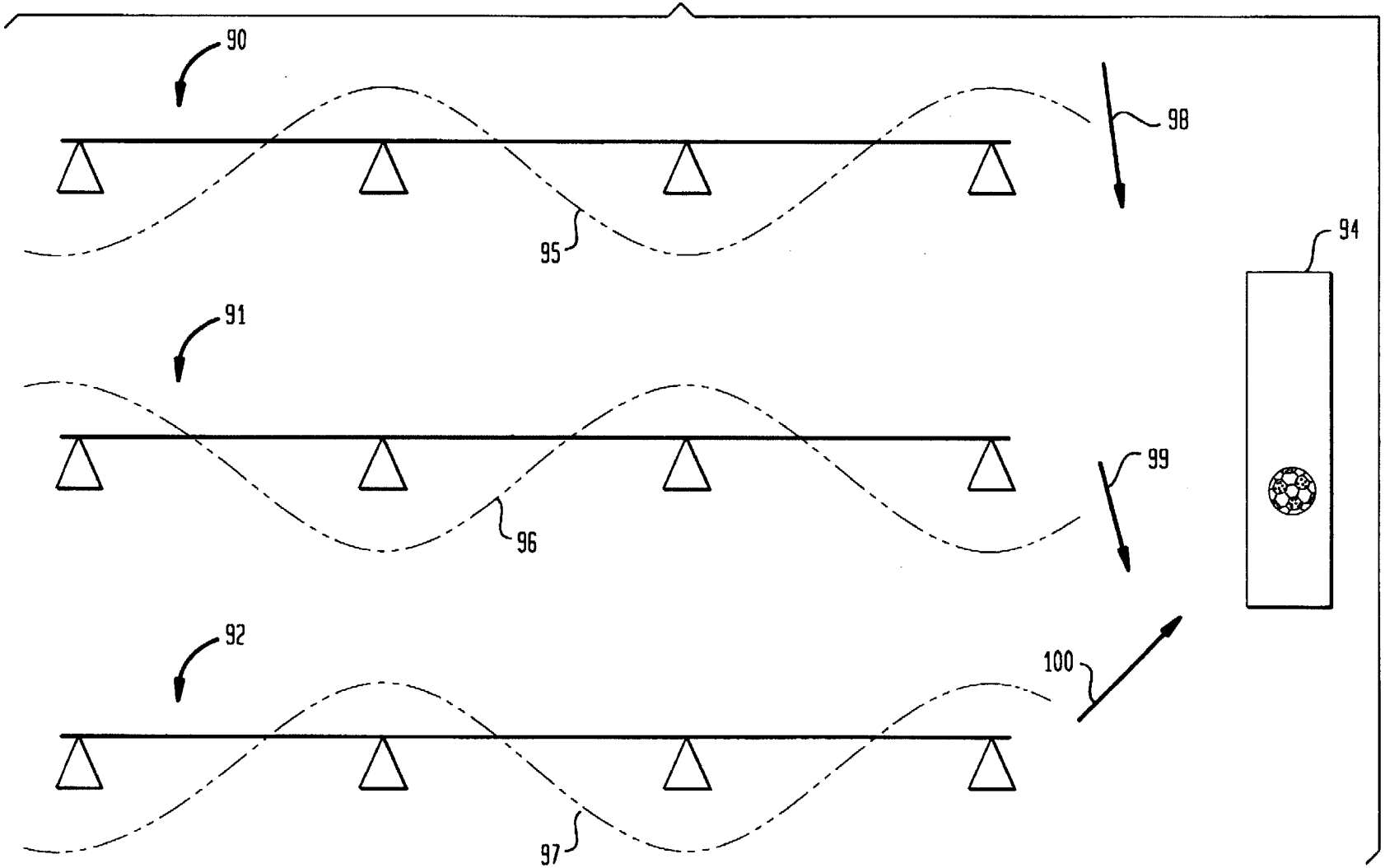
FIG. 8 is a schematic representation illustrating the use of the invention in a drill simulating a wing attack play.

FIG. 8 is a schematic representation illustrating the use of the invention in another offensive tactic, particularly in the simulation of a wing attack play. As shown, three stanchion systems 90, 91, 92, as previously described, are arranged in a substantially straight line parallel arrangement, with a goal 94 at one end thereof. Three players (not shown) run along respective paths 95, 96, and 97, only the player on path 95 having possession of a ball. When all three players reach the end of their respective paths in the vicinity of goal 94, the player on path 95, as indicated by arrow 98, passes the ball to the player on path 96. The player on path 96, upon receiving the ball, uses a wall pass to pass the ball to the player on path 97, as indicated by arrow 99. The player on line 97 then takes a shot on goal, as indicated by arrow 100. Goalie training is enhanced by placing a goalie player (not shown) in the vicinity of goal 94 to defend same.

Figure 9:
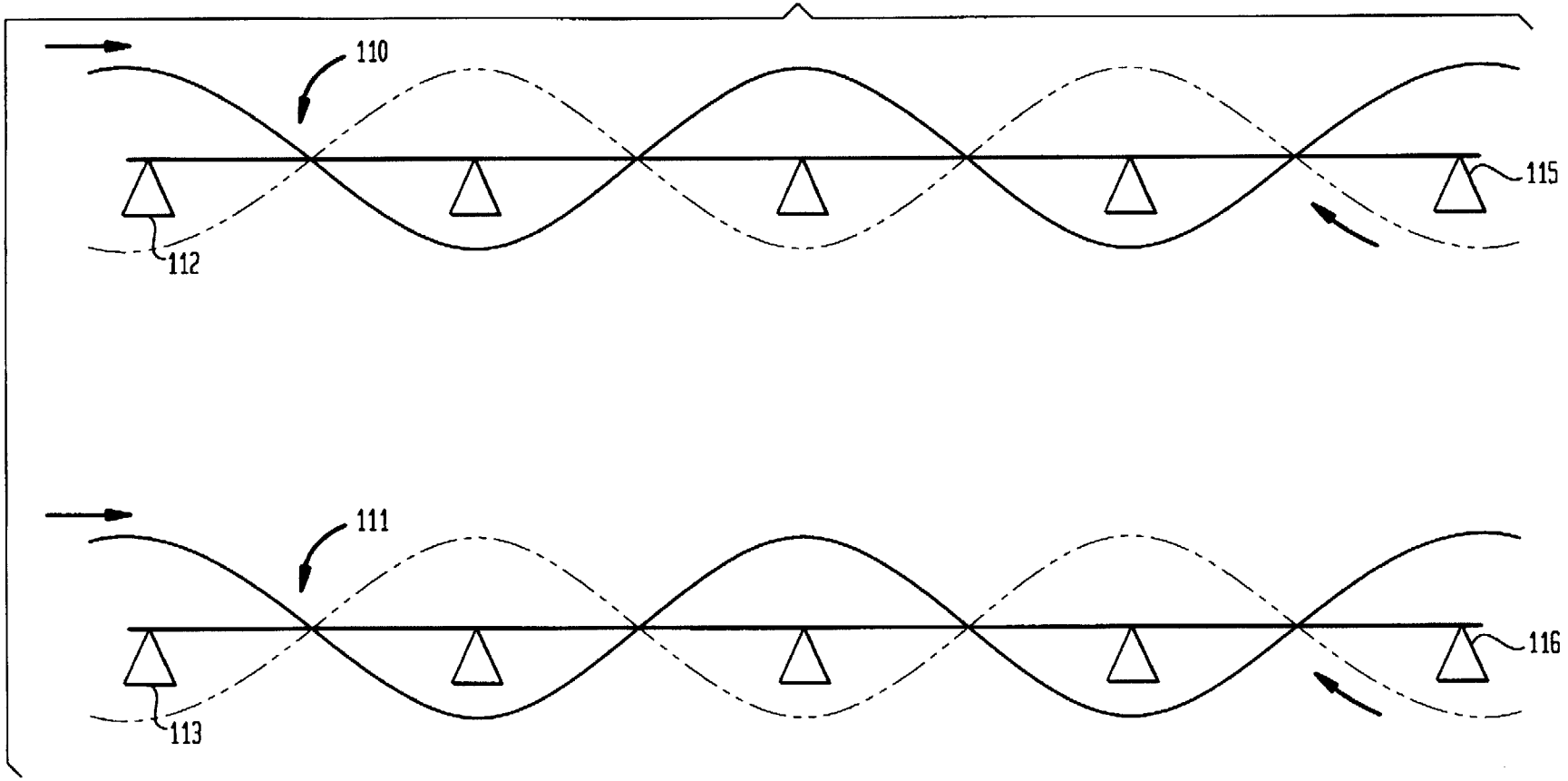
FIG. 9 is a representation of the invention employed to effect physical development in a relay race context.

FIG. 9 is a representation of the invention implemented to effect physical development in a relay race context. As shown, two stanchion systems 110 and 111 are arranged substantially parallel to one another. However, they need not be straight. Each of the stanchion systems has a respectively associated one of starting stanchions 112 and 113, and an associated one of end stanchions 115 and 116. Each of the stanchion systems has an associated group of players, the groups having equal numbers of players (not shown). The exercise begins for both groups simultaneously upon the blowing of a whistle. A player from each group dribbles the soccer ball (not shown) along the path shown, reversing his or her direction around the respective one of end stanchions 115 and 116. Upon passing the respective starting stanchion, the players pass the ball to another player from their group, in relay fashion, who performs the same exercise. When all of the players have completed the exercise, the group sits down, and the first group to sit is the winner.

Figure 10:
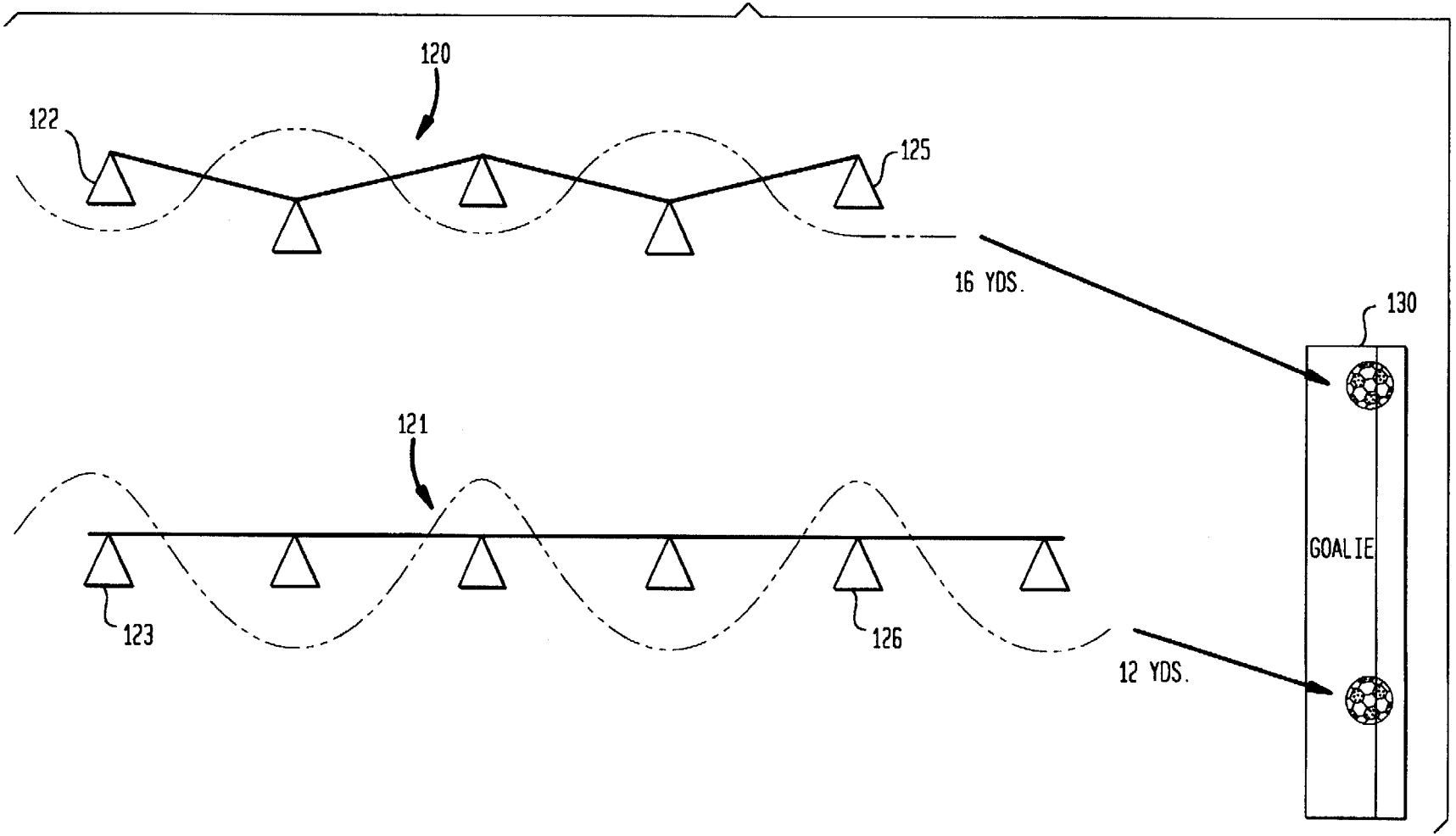
FIG. 10 is a schematic representation of a relay implementation of the invention whereby athletes are trained to run and shoot at different distances from the goal.

FIG. 10 is a schematic representation of a relay implementation of the invention whereby athletes are trained to run and shoot from different distances of the goal. The invention is deployed to effect a ball control shooting drill. As shown, two stanchion systems 120 and 121 are arranged substantially parallel to one another. They need not be straight. Each of the stanchion systems has a respectively associated one of starting stanchions 122 and 123, and an associated one of end stanchions 125 and 126. Each of the stanchion systems has an associated group of players, the groups having equal numbers of players (not shown). The exercise begins for both groups simultaneously upon the blowing of a whistle. A player from each group dribbles the soccer ball (not shown) along the path shown, until he or she reaches a respective one of end stanchions 125 and 126. The player who traversed stanchion system 120 takes a 16-yard shot at goal 130, and the player who traversed stanchion system 121 takes a 12-yard shot at the same goal. The players are instructed to aim for the lower portion of the inside goal post (not shown in this figure). Each player, upon completing his or her goal shot, will proceed to traverse the other stanchion system. Goalie training is enhanced by placing a goalie player (not shown) in the vicinity of goal 130 to defend same.

Although the invention has been described in terms of specific embodiments and applications, persons skilled in the art can, in light of this teaching, generate additional embodiments without exceeding the scope or departing from the spirit of the claimed invention. Accordingly, it is to be understood that the drawing and description in this disclosure are proffered to facilitate comprehension of the invention, and should not be construed to limit the scope thereof.

What is claimed is:

1. A system for training an athlete in a kicking dribble skill with a soccer ball on a playing surface, the system comprising:

flexible dribble path defining means for defining a dribble path on the playing surface along which the athlete is to be trained; and a plurality of stanchion means for maintaining said flexible dribble path defining means along the dribble path at a predetermined height above the playing surface, the predetermined height being sufficient to permit the soccer ball to be dribbled by the athlete between the playing surface and said flexible dribble path defining means.

2. The system of claim 1, wherein said plurality of stanchion means each comprise a base portion having a first end for resting on the playing surface and a second end for communicating with said flexible dribble path defining means.

3. The system of claim 2, wherein said stanchion means are internally hollow, thereby defining an internal volume, and where there is further provided inlet means for facilitating loading and unloading of a weighting material with respect to the internal volume of said stanchion means.

4. The system of claim 2, wherein said stanchion means are configured to be nestable substantially within one another for enhancing compactness of said plurality of stanchion means during relocation of the system.

5. The system of claim 2, wherein there is further provided a plurality of engagement means each installed on a first end of a respective one of said stanchion means for engaging said flexible dribble path defining means.

6. The system of claim 2, wherein said stanchion means each have a substantially conical configuration with a broader end thereof at said first end of said stanchion means.

7. A method of trig an athlete in a kicking dribble skill with a soccer ball on a playing surface, the system comprising:

determining a dribble path over which the athlete is to be trained;

installing a flexible dribble path defining element for defining a dribble path on the playing surface along which the athlete is to be trained; and maintaining the flexible dribble path defining means along the dribble path at a predetermined height above the playing surface, the predetermined height being sufficient to permit the soccer ball to be dribbled by the athlete between the playing surface and said flexible dribble path defining element.

8. The method of claim 7, wherein there are further provided the steps of:

first kicking the soccer ball in a first ball travel direction under the flexible dribble path defining element and at least partially along a first direction of the dribble path;

first jumping over the flexible dribble path defining element at a first location therealong;

second kicking the soccer ball in a second direction under the flexible dribble path defining element and at least partially along the first direction of the dribble path; and second jumping over the flexible dribble path defining element at a second location therealong, said second location being further along the dribble path in the first direction.

9. The method of claim 8, wherein there is further provided the step of repeating said steps of first kicking, first jumping, second kicking, and second jumping until the athlete has traversed a first predetermined portion of the dribble path.

10. The method of claim 8, wherein there are further provided the steps of:

third kicking the soccer ball in a third ball travel direction under the flexible dribble path defining element and at least partially along a second direction of the dribble path;

third jumping over the flexible dribble path defining element at a third location therealong;

fourth kicking the soccer ball in a fourth direction under the flexible dribble path defining element and at least partially along the second direction of the dribble path;

fourth jumping over the flexible dribble path defining element at a fourth location therealong, the fourth location being further along the dribble path in the second direction.

11. The method of claim 10, wherein there is further provided the step of repeating said steps of third kicking, third jumping, fourth kicking, and fourth jumping until the athlete has traversed a second predetermined portion of the dribble path.

12. A system for training an athlete in a kicking dribble skill with a soccer ball on a playing surface, the system comprising:

flexible means for defining a dribble path on the playing surface along which the athlete is to be trained;

stanchion means for supporting said flexible means along the dribble path at a height above the playing surface sufficient to permit the soccer ball to be dribbled thereunder by the athlete, said stanchion means having:

a base portion for supporting said stanchion means on the playing surface;

an elongated central portion; and a top portion;

engagement means coupled to said top portion for engaging with said flexible means.

13. The system of claim 12, wherein said flexible means comprises an elongated cord.

14. The system of claim 13, wherein said elongated central portion and said top portion of said stanchion means are integrally formed.

15. The system of claim 13, wherein said engagement means and said top portion of said stanchion means are integrally formed.

16. The system of claim 15, wherein said engagement means comprises a notch or aperture for engaging said flexible means.

17. The system of claim 13, wherein said engagement means comprises a sliding member for engaging slidably with said flexible means, whereby said flexible means is axially movable with respect to said engagement means.

18. The system of claim 17, wherein said engagement means is arranged to couple with said top portion of said stanchion means.

19. The system of claim 12, wherein said elongated central portion is hollow, and there is further provided with means for accessing the hollow interior of said elongated central portion for supplying and removing a weighting material.

20. The system of claim 12, wherein said elongated hollow portion has a substantially conical configuration that has a first diameter in the vicinity of the top portion, and a second, larger diameter in the vicinity of said base portion.

21. A method of training a soccer athlete, the method comprising the steps of:

urging a soccer ball along the ground in a first direction between first and second spaced-apart stanchions; and jumping in said first direction over a flexible element arranged to be supported above the ground by the first and second spaced-apart stanchions.

22. The method of claim 21, wherein there are provided further the steps of:

urging the soccer ball along the ground in a second direction between the first and second spaced-apart stanchions; and jumping in the second direction over the flexible element.

23. The method of claim 21, wherein there are further provided the steps of dribbling the soccer ball around the second stanchion and repeating the steps of urging and jumping.

24. The method of claim 21, wherein there is further provided a third stanchion arranged sequentially with the first and second stanchions, the flexible element being arranged to be supported above the ground by the first, second, and third stanchions, there being provided, after said step of jumping, the further steps of:

second urging the soccer ball along the ground in a second direction between the second and third spaced-apart stanchions; and second jumping in the second direction over the flexible element between the second and third spaced-apart stanchions.

25. The method of claim 24, wherein there is further provided the step of shooting the ball at a goal.

26. The method of claim 24, wherein there is further provided the step of passing the ball to a receiving player.

* * * * *